US007264509B1

(12) United States Patent
McAlonis et al.

(10) Patent No.: US 7,264,509 B1
(45) Date of Patent: Sep. 4, 2007

(54) MODULAR CONNECTOR ASSEMBLY UTILIZING A GENERIC LEAD FRAME

(75) Inventors: Matthew Richard McAlonis, Elizabethtown, PA (US); Jeffrey Joe Brown, Palmyra, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/409,689

(22) Filed: Apr. 24, 2006

(51) Int. Cl.
*H01R 13/648* (2006.01)
*H01R 13/52* (2006.01)

(52) U.S. Cl. ..... 439/608

(58) Field of Classification Search ..... 439/79, 439/163, 475, 924.1, 608, 701; 29/874, 876, 29/884
See application file for complete search history.

(56) References Cited

U.S. PATENT DOCUMENTS 4,593,463 A * 6/1986 Kamono et al. ..... 29/884
4,914,806 A * 4/1990 Taguchi et al. ..... 29/622
5,061,196 A * 10/1991 Weston et al. ..... 439/189
5,990,425 A * 11/1999 McSwiggen ..... 200/16 R
6,171,149 B1 * 1/2001 van Zanten ..... 439/608
6,267,604 B1 * 7/2001 Mickievicz et al. ..... 439/79
6,554,647 B1 * 4/2003 Cohen et al. ..... 439/607
6,638,121 B1 * 10/2003 Walker et al. ..... 439/885
6,652,327 B2 * 11/2003 Lau et al. ..... 439/717
6,932,649 B1 * 8/2005 Rothermel et al. .... 439/620.01
7,175,479 B1 * 2/2007 McAlonis et al. ..... 439/701
7,195,519 B1 * 3/2007 McAlonis et al. ..... 439/608
2006/0189212 A1 * 8/2006 Avery et al. ..... 439/608

* cited by examiner

*Primary Examiner*—Ross Gushi
*Assistant Examiner*—Larisa Tsukerman

(57) ABSTRACT

An electrical connector is provided having a housing and multiple contact modules loaded in the housing. Each contact module includes an array of contacts held in a dielectric carrier. Each array of contacts includes multiple contacts formed as part of a generic lead frame. The contacts in each array are spaced-apart from each other in a respective contact pattern. At least two contact modules hold different first and second patterns of the contacts, wherein the contacts in the first pattern have a first spaced-apart relationship and the contacts in the second pattern have a different second spaced-apart relationship. The generic lead frame includes both the first and second patterns of contacts such that either one of the first and second patterns may be selectively obtained from the generic lead frame.

13 Claims, 9 Drawing Sheets

MODULAR CONNECTOR ASSEMBLY UTILIZING A GENERIC LEAD FRAME

BACKGROUND OF THE INVENTION

The present invention generally relates to an electrical connector, and more particularly to a modular connector assembly that utilizes a generic lead frame structure, from which multiple contact patterns may be formed.

Various connector designs exist today for different applications. Certain connector designs have been proposed to interconnect signal and power lines between a backplane and a printed circuit or daughter board. In many applications, industry standards have been developed to standardize and define certain aspects of board-to-board interfaces. One such standard is the Advanced Telecom Computing Architecture (Advanced TCA) standard which defines several physical and electrical characteristics of a board-to-board interface. In one aspect of the Advanced TCA standard, the backplane is divided into various zones, where at least one zone is defined for power and management, while a second zone is defined for data transport, and a third zone is reserved for user defined rear I/O. In general, Advanced TCA connectors are constructed as right angle connectors and may utilize pin or blade contacts to plug into a backplane or a mating connector.

Conventional Advanced TCA connectors include contacts having a variety of sizes, lengths and spacings that are somewhat dependent upon the connector performance requirements. The Advanced TCA standard defines the location of, and the spacing between, contacts in the power zone and in the signal zone of the connector. Conventional connectors that are configured for use with the Advanced TCA standard have been constructed by individually manufacturing and loading each signal contact and each power contact into the connector housing. The signal and power contacts are individually screw machined and plated. The contacts are individually manufactured into specific respective housing locations which creates an opportunity for improper insertion. The contacts may have different lengths and thus during the individual contact insertion process, a risk exists that the wrong contact is inserted into a contact position in the connector housing. Also, the conventional assembly process requires numerous loose contacts to be handled individually. Further, the contacts must be bent before or after they are loaded into the housing to form the right angle arrangement. Conventional manufacturing and assembly processes are slow, labor-intensive, costly and subject to error.

A need remains for an improved electrical connector that overcomes the problems discussed above and experienced heretofore.

BRIEF DESCRIPTION OF THE INVENTION

In accordance with one embodiment, an electrical connector is provided having a housing and multiple contact modules loaded in the housing. Each contact module includes an array of contacts held in a dielectric carrier. Each array of contacts includes multiple contacts formed as part of a generic lead frame. The contacts in each array are spaced-apart from each other in a respective contact pattern. At least two contact modules hold different first and second patterns of the contacts, wherein the contacts in the first pattern have a first spaced-apart relationship and the contacts in the second pattern have a different second spaced-apart relationship. The generic lead frame includes both the first and second patterns of contacts such that either one of the first and second patterns may be selectively obtained from the generic lead frame.

In accordance with one embodiment, the dielectric carrier may be formed with a back shell and a cover that enclose a corresponding one of the first and second patterns of contacts. At least one of the back shell and cover includes an arrangement of ribs and channels formed therein to receive the contacts. The channels are arranged in a generic pattern that encompasses both of the first and second patterns such that any back shell and cover is configured to receive either of the first and second patterns of contacts.

In accordance with an alternative embodiment, a method is provided for manufacturing an electrical connector. The method includes providing a series of generic lead frames on a common carrier strip, where each of the generic lead frames has an array of contacts that are arranged in a common generic pattern. The method includes removing, from one of the generic lead frames, a first subset of the contacts to form a first pattern of contacts having a first spaced-apart relationship. The method also includes removing, from another of the generic lead frames, a second subset of the contacts to form a second pattern of contacts having a different second spaced-apart relationship. The first and second patterns are selectively obtained from the generic pattern. The method further includes loading the first pattern of contacts into a housing.

Optionally, the method may further include forming a dielectric carrier to hold the first and second patterns of contacts in respective first and second contact modules. Each dielectric carrier may have a back shell and a cover that are pressed together to enclose the contacts. At least one of the back shell and cover have a universal array of ribs and channels formed therein that corresponds to both of the first and second patterns of contacts such that any one of the back shells and covers may be configured to receive either of the first and second patterns of contacts.

DETAILED DESCRIPTION OF THE INVENTION

Figure 1:
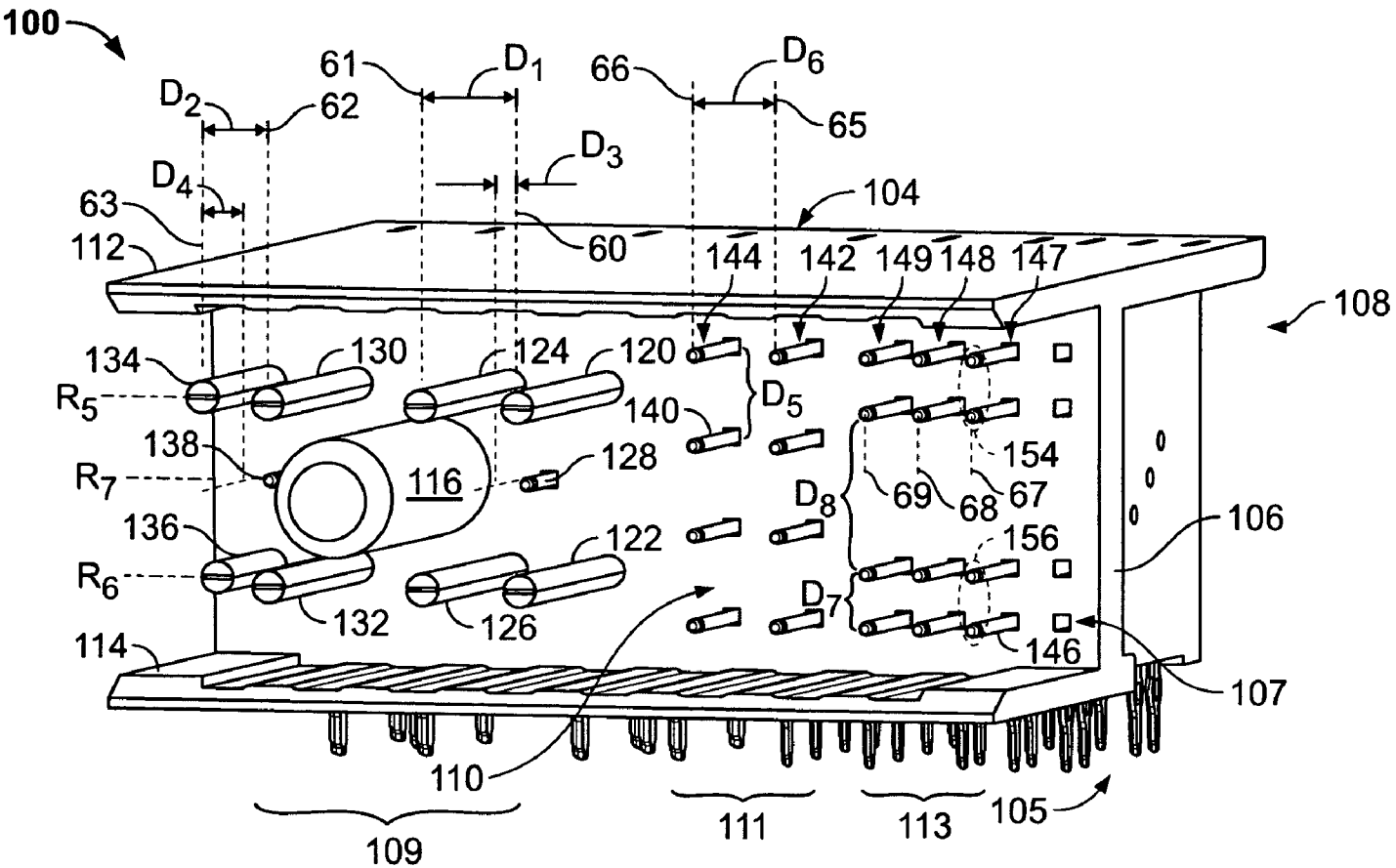
FIG. 1 illustrates a front perspective view of an electrical connector formed in accordance with an embodiment of the present invention.

FIG. 1 illustrates a front perspective view of an electrical connector 100 formed in accordance with an exemplary embodiment of the present invention. While the connector 100 will be described with particular reference to an Advanced TCA compliant power connector, it is to be understood that the benefits herein described are also applicable to other connectors and alternative applications. The following description is therefore provided for purposes of illustration, rather than limitation, and are but some potential applications of the inventive concepts herein.

The connector 100 includes a housing 104 having a mounting end 105 and having a front wall 106 that separates a mating end 110 from a loading end 108. The housing 104 includes forward upper and lower shrouds 112 and 114, respectively, that extend forward from the front wall 106 toward the mating end 110. The upper and lower shrouds 112 and 114 may have alignment features and latching features to facilitate engagement with a mating connector. A guide post 116 extends forward from the front wall 106 toward the mating end 110 and facilitates engagement with a mating connector. The front wall 106 has a pin pattern 107 therethrough to receive pins of signal and power contacts. The pin pattern 107 is apportioned into zones or sections, such as a power delivery section 109, a first signal section 111 and a second signal section 113.

The power delivery section 109 includes, on opposite sides of the guide post 116, sets of power contacts that are grouped with signal contacts. For example, power contacts 120, 122, 124, and 126 are grouped with signal contact 128, all of which extend through the front wall 106 and are located on one side of the guide post 116. Power contacts 130, 132, 134, and 136 are grouped with signal contact 138, all of which extend through the front wall 106 and are located on the other side of the guide post 116. Power contacts 120 and 122 are vertically aligned with one another along a corresponding vertical centerline 60. Similarly, power contacts 124 and 126, power contacts 130 and 132, and power contacts 134 and 136 are aligned along corresponding vertical centerlines 61-63. The power contacts 120, 124, 130 and 134 are arranged in an upper horizontal row $R_5$, while power contacts 122, 126, 132, and 136 are arranged in a lower horizontal row $R_6$. The signal contacts 128 and 138 are arranged in an intermediate horizontal row $R_7$.

Power contacts 120 and 124 are laterally spaced from one another by a distance $D_1$. Power contacts 122 and 126 are also laterally spaced from one another by the distance $D_1$. Power contacts 130 and 134 are spaced laterally apart by a distance $D_2$. Power contacts 132 and 136 are also spaced laterally apart by the distance $D_2$. The distance $D_1$ is different than the distance $D_2$. The signal contact 128 is spaced a distance $D_3$ from the centerline 60 defined by the power contacts 120 and 122, and the signal contact 138 is spaced a distance $D_4$ from the centerline 63 defined by the power contacts 134 and 136. The distance $D_3$ is different than the distance $D_4$.

The first signal section 111 includes signal contacts 140 that are arranged in columns 142 and 144 along parallel vertical centerlines 65 and 66. Within each column 142 and 144, the signal contacts 140 are evenly spaced from one another by a distance $D_5$. Adjacent columns 142 and 144 are laterally separated from one another by a distance $D_6$.

The second signal section 113 includes signal contacts 146 that are arranged in columns 147-149 along parallel vertical centerlines 67-69. Within each column 147-149, the signal contacts 146 are arranged in pairs 154 and 156. The signal contacts 146 in a pair 154 or 156 are separated by a distance $D_7$ (hereafter referred to as an intra-pair spacing), while pairs 154 and 156 are separated by a distance $D_8$ (hereafter referred to as an inter-pair spacing). The spacing between adjacent columns 147-149 may vary depending upon the application, and may differ from the spacing between the columns 142 and 144 in the first signal section 111.

Figure 2:
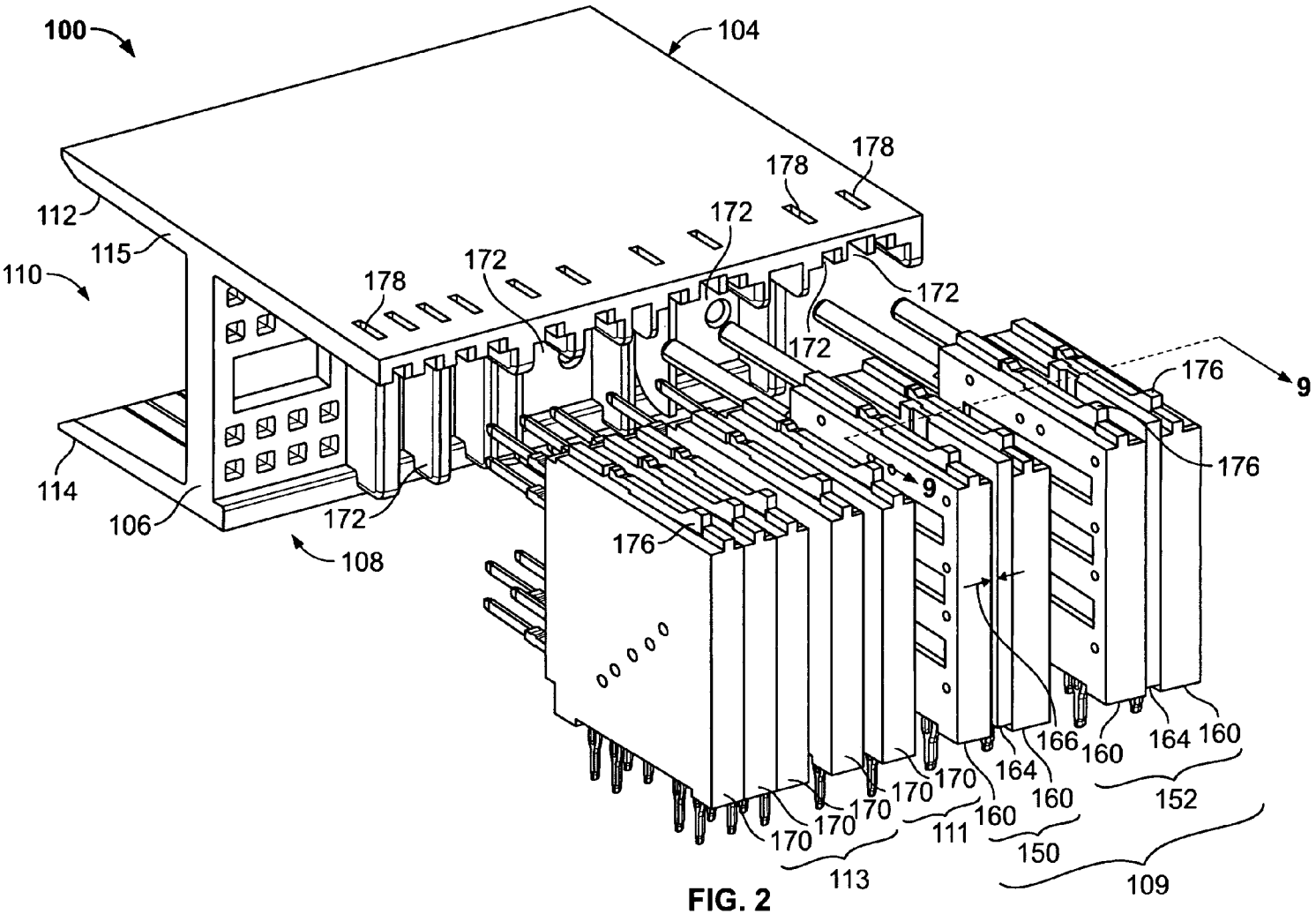
FIG. 2 illustrates an exploded rear perspective view of the electrical connector of FIG. 1 with signal and power contact modules aligned to be loaded.

FIG. 2 illustrates an exploded rear perspective view of the connector 100 and a series of signal contact modules 170 and power contact modules 150 and 152 that are aligned to be loaded. As shown in FIG. 2, the front wall 106 includes a module support shroud 115 that extends toward the loading end 108. The module support shroud 115 includes a series of slots 172 provided therein that extend from the front wall 106 and open downward. The slots 172 may be dimensioned differently to ensure loading of a corresponding power or signal contact module 150, 152 or 170. The power delivery portion 109 of the connector 100 receives a first power module 150 and a second power module 152. Power module 150 includes power contacts 120, 122, 124, and 126 and signal contact 128 (FIG. 1). Power module 152 includes power contacts 130, 132, 134, and 136 and signal contact 138. Each of power modules 150 and 152 includes a pair of contact wafer assemblies 160 separated by a spacer 164. The power contact wafer assemblies 160 are interchangeable. Optionally, the power contact modules 150 and 152 may each include a single power contact wafer assembly 160, in which case the terms "module" and "wafer assembly" would be used interchangeably to refer to a common structure. The power contact wafer assembly 160 includes a pair of power contacts that may be either power contacts 120 and 122, power contacts 124 and 126, power contacts 130 and 132 or power contacts 134 and 136 depending on the position in the power modules 150 and 152.

The wafer spacer 164 establishes and maintains the distance $D_1$ and distance $D_2$ (FIG. 1) within the power modules 150 and 152 depending on the orientation of the spacer 164 relative to the power modules 150 and 152. When the spacer 164 is in one orientation, a gap 166 is produced between the spacer 164 and the power contact wafer assembly 160 as in power module 150. When the spacer 164 is in another orientation, the spacer 164 fits flush with the power contact wafer assembly 160 as shown in power module 152. The spacer 164 also holds a signal contact that may be either signal contact 128 (FIG. 1) or signal contact 138 depending on the power module 150 or 152, in which the spacer 164 is placed. The orientation of the spacer 164 establishes and maintains the distance $D_3$ and distance $D_4$ within the power module 150 and 152.

The signal sections 111 and 113 of the connector 100 receive signal contact modules 170 that may comprise one or more wafer assemblies. The signal contact modules 170 each include a pattern of contacts (FIG. 1) corresponding to one of the columns 142, 144 and 147-149 of signal contacts 140 and 146, respectively. The power wafer assemblies 160, spacers 164, and signal contact modules 170 are received in corresponding slots 172 that are formed in the connector housing 104. Each power and signal contact module 150, 152 and 170 includes a latch 176 that is received in a corresponding window 178 formed in the module support shroud 115. The latches 176 and corresponding windows 178 cooperate to lock the power and signal contact modules 150, 152 and 170 in the housing 104.

Figure 3:
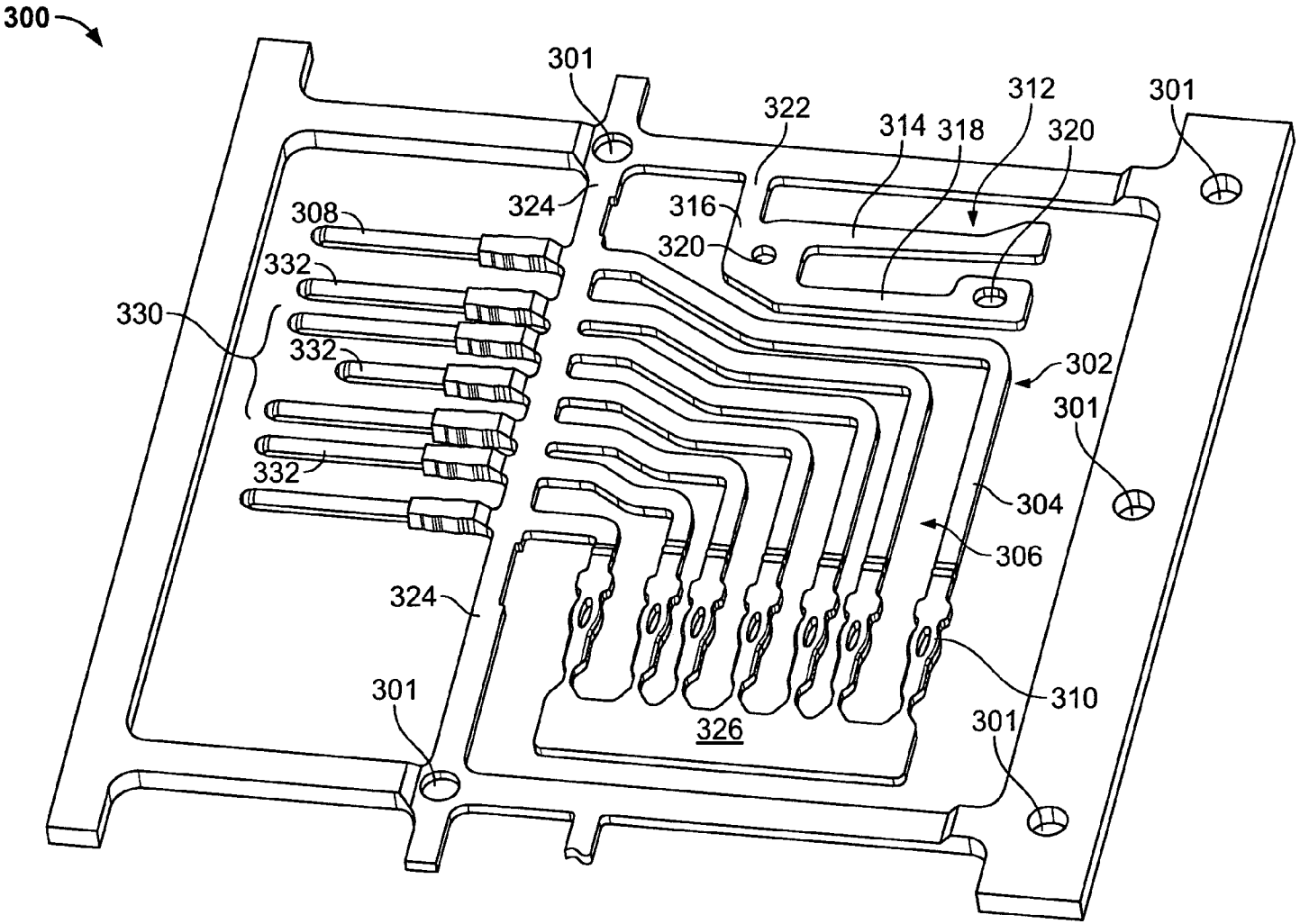
FIG. 3 illustrates a portion of a carrier strip holding a generic lead frame during a manufacturing process implemented in accordance with an embodiment of the present invention.

FIG. 3 illustrates a portion of a carrier strip 300 that has a master or generic lead frame 302 stamped therein. The carrier strip 300 includes a series of generic lead frames 302 (only one of which is shown), all of which have a common or master contact pattern. The carrier strip 300 includes a series of holes 301 distributed thereabouts that are used during manufacture to convey the carrier strip 300 along an assembly process between stages. The generic lead frame 302 comprises multiple contacts 304 that are formed in an array and are spaced-apart from one another by contact-to-contact gaps 306. The widths of the contact-to-contact gaps 306 differ depending upon the contact configuration. Each contact 304 has a connector mating pin 308 provided at one end thereof and a board mounting pin 310 provided at the opposite end. In the embodiment of FIG. 3, the board mounting pins 310 are formed as "eye of the needle" pins. The connector mating pins 308 may have different links from one another as shown in FIG. 3. The contacts 304 in the generic lead frame 302 are held within the carrier strip 300 by tabs 324, while a linking bar 326 joins the board mounting pins 310. The tabs 324 and the linking bar 326 maintain adjacent contacts 304 in a predetermined spaced-apart relationship and orientation with respect to one another and with respect to the carrier strip 300.

The carrier strip 300 also includes a retention latch member 312 stamped therein at the same time as the generic lead frame 302. The retention latch member 312 includes a latch beam 314 that is joined at a link area 316 to a latch base 318. The latch beam 314 and latch base 318 extend along generally parallel axes. The link area 316 and an outer end of the latch base 318 include holes 320 there through. The retention latch member 312 is held on the carrier strip 300 by a tab 322. The tab 322 maintains the retention latch member 312 in a predetermined spaced-apart relationship and orientation with respect to the carrier strip 300 and generic lead frame 302.

Next, an exemplary contact removing or "dejunking" process is described in which different subsets of the contacts 304 are removed to form select different contact patterns. For the purposes of illustration, attention is directed to subsets 330 and 332 of contacts 304. Subset 330 is removed to form one pattern of contacts from the generic lead frame 302, while subset 332 is removed to form a different pattern of contacts from the generic lead frame 302. The subset 330 includes a central cluster of contacts 304, while the subset 332 includes every other contact 304 in the generic lead frame 302.

Figure 4:
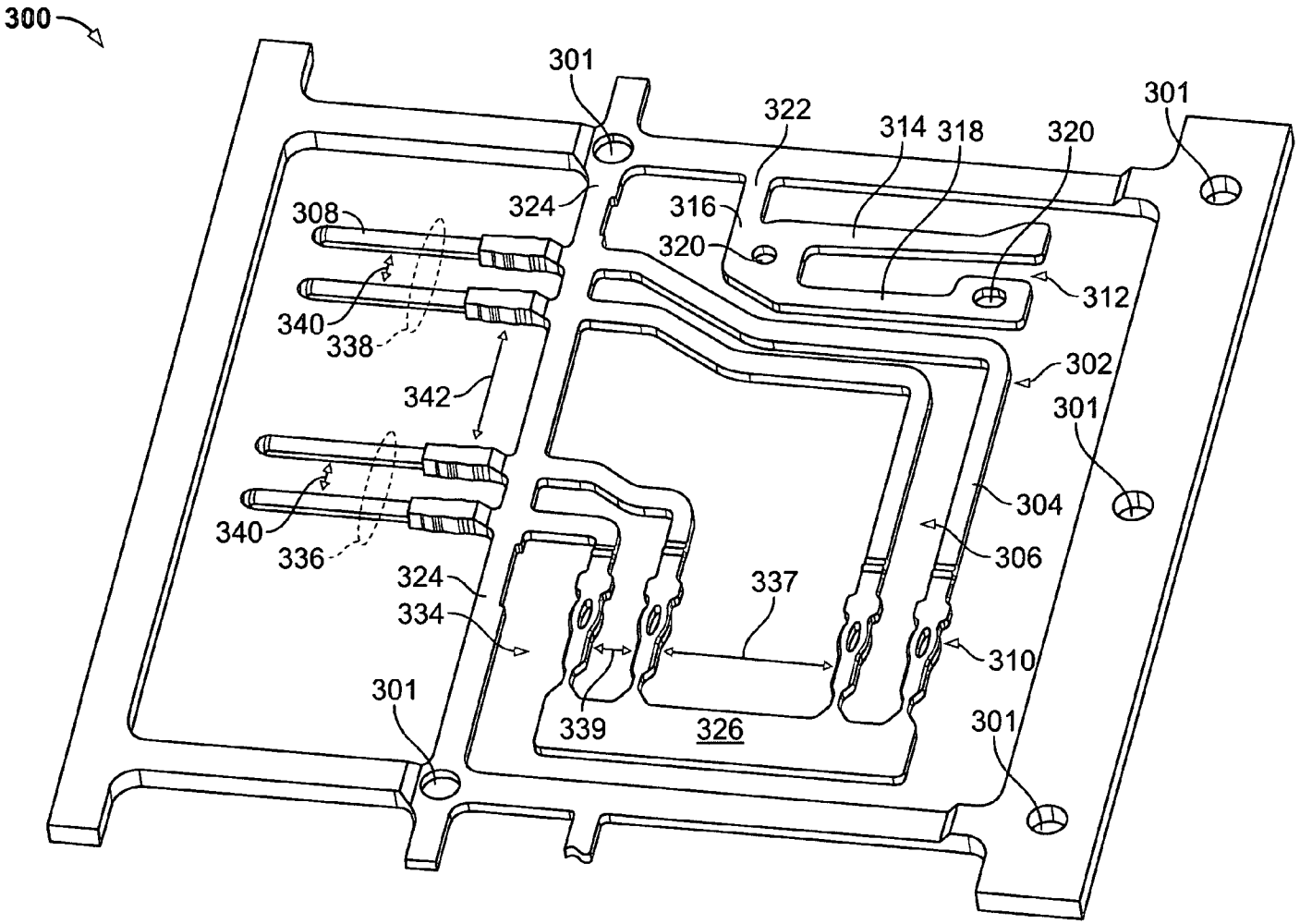
FIG. 4 illustrates a first pattern of contacts formed from the generic lead frame after removal of a first subset of contacts.

FIG. 4 illustrates the generic lead frame 302 with the subset 330 of central clustered contacts 304 removed or dejunked to form a first contact pattern 334. The contact pattern 334 includes contact pairs 336 and 338 of contacts 304 that are arranged in a predetermined spaced-apart relationship. The spaced-apart relationship in the contact pattern 334 includes a common intra-pair spacing 340 between adjacent contacts 304 in each of the contact pairs 336 and 338. The spaced-apart relationship in the contact pattern 334 also includes an inter-pair spacing 342 between adjacent contact pairs 336 and 338. The intra-pair spacings 340 are less than the inter-pair spacing 342. By way of example, the first contact pattern 334 may be useful to convey signals arranged in differential pairs. The intra-pair spacings 340 and inter-pair spacing 342 are illustrated in FIG. 4 at the connector mating pins 308, but may be substantially maintained throughout the lead frame 302. At the board mounting pins 310, the contacts 304 also exhibit intra-pair spacing 339 and an inter-pair spacing 337, although the distances between adjacent board mounting pins 310 may not necessarily be equal to the distance between corresponding adjacent connector mating pins 308.

Figure 5:
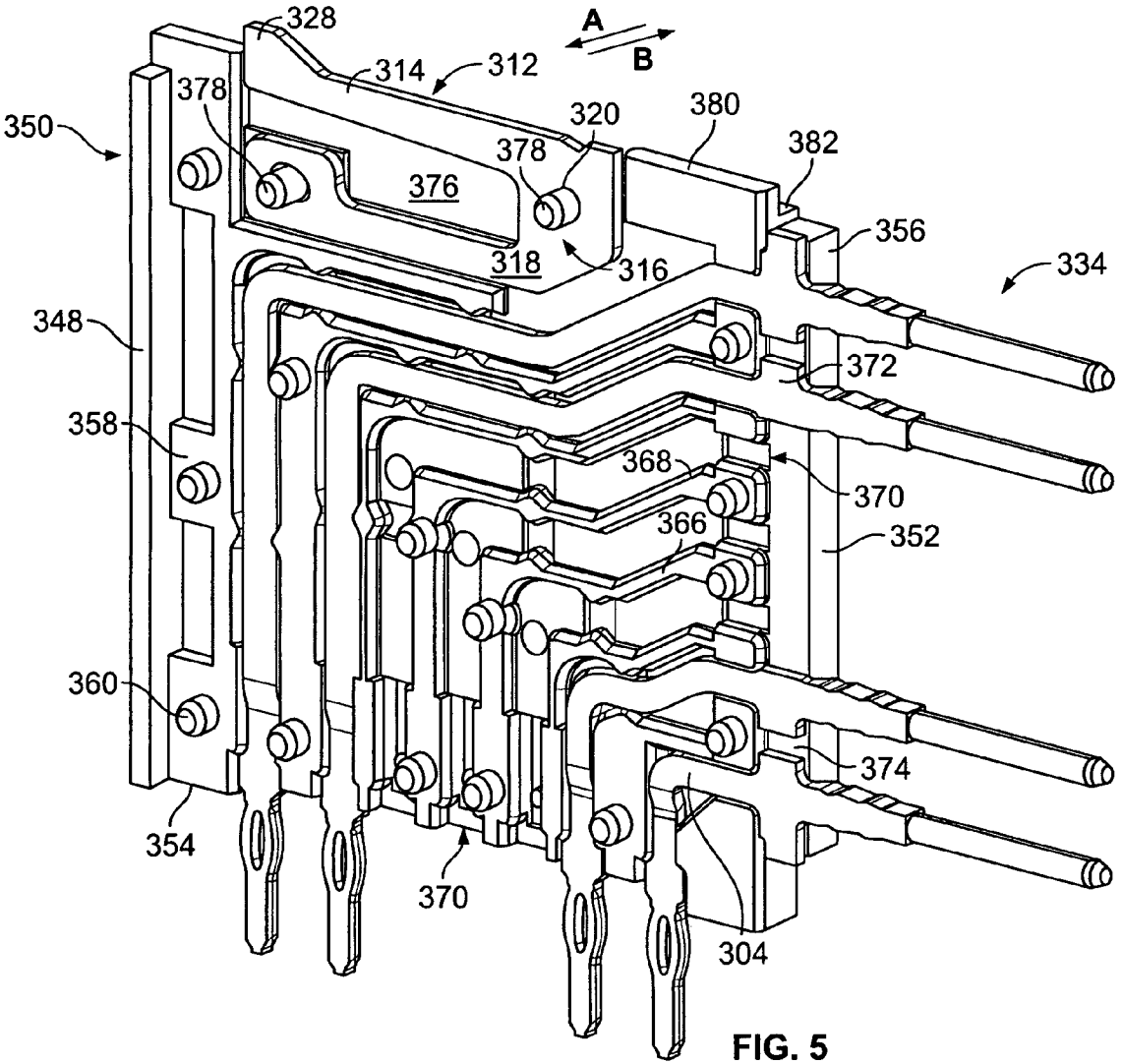
FIG. 5 illustrates the first pattern of contacts of FIG. 4 loaded in a back shell of a contact module.

FIG. 5 illustrates a side perspective view of the first contact pattern 334 (FIG. 4) when mounted in a back shell 350 of a dielectric carrier which forms a portion of a signal contact module or wafer assembly (as explained below in more detail). The back shell 350 includes a connector mating edge 352 and a board mounting edge 354 that are arranged at a right angle to one another in the exemplary embodiment. It is understood that in other configurations, the mating edge 352 and board mounting edge 354 may not be oriented at a right angle to one another. The back shell 350 includes an outer surface 356, an inner surface 358, a top edge 382, and a rear ledge 348. The inner surface 358 includes a series of ribs 366 that are separated from one another to form channels 368 there between. The ribs 366 and channels 368 extend between the mating and board mounting edges 352 and 354 along curved paths that substantially follow the curvature of contacts 304. The channels 368 are open at opposite ends 370.

Adjacent contacts 304 are separated from one another at gaps 374 during the manufacturing process before or after being loaded into the back shell 350. Once the adjacent contacts 304 are separated at gaps 374, shoulder portions 372 remain and are located proximate to the ends 370 of the channels 368. The shoulders 372 resist movement of the contacts 304 relative to the back shell 350 during mating operations, and retain the contacts 304 in a desired spaced-apart relationship with respect to one another.

The ribs 366 and channels 368 are arranged in a master or generic channel pattern that corresponds to the common or master contact pattern of the generic lead frame 302 (FIG. 3). By providing a generic channel pattern in the back shell 350, any back shell 350 may be used with any contact pattern formed from the generic lead frame 302, independent of the subset (330, 332 or otherwise) of contacts 304 that is removed. The back shell 350 also includes a distribution of pins 360 that project from the inner surface 358. The pins 360 are positioned to be received in corresponding holes 388 (FIG. 6) in a mating cover 364 when the cover 364 is securely joined to the back shell 350. The back shell 350 and cover 364 cooperate to form a dielectric carrier that surrounds and holds an array of contacts 304 in the first contact pattern 334. The rear ledge 348 extends along the back side of the back shell 350.

The back shell 350 also includes a cavity 376 that receives the retention latch member 312. Pins 378 are located in the cavity 376 and are aligned to be inserted through the holes 320 in the retention latch member 312 in order to position and retain the retention latch member 312 in a desired relation relative to the back shell 350. The back shell 350 includes an alignment rail 380 extending upward from the top edge 382. The alignment rail 380 is configured to be received in a corresponding slot 172 in the module support shroud 115 (FIG. 2). The retention latch member 312 includes a protrusion 328 that extends upward from an outer end of the latch beam 314. The protrusion 328 extends above the alignment rail 380. During a loading operation, as the alignment rail 380 is received in the corresponding slot 172, the latch beam 314 is deflected downward in the direction of arrow A to permit the protrusion 328 to pass into the slot 172 until aligning with the window 178. When the protrusion 328 aligns with the window 178, the latch beam 314 moves in the direction of arrow B to securely position the protrusion 328 within the window 178. The pins 378 prevent the link area 316 and latch base 318 from moving relative to the back shell 350 during the latching process.

Figure 6:
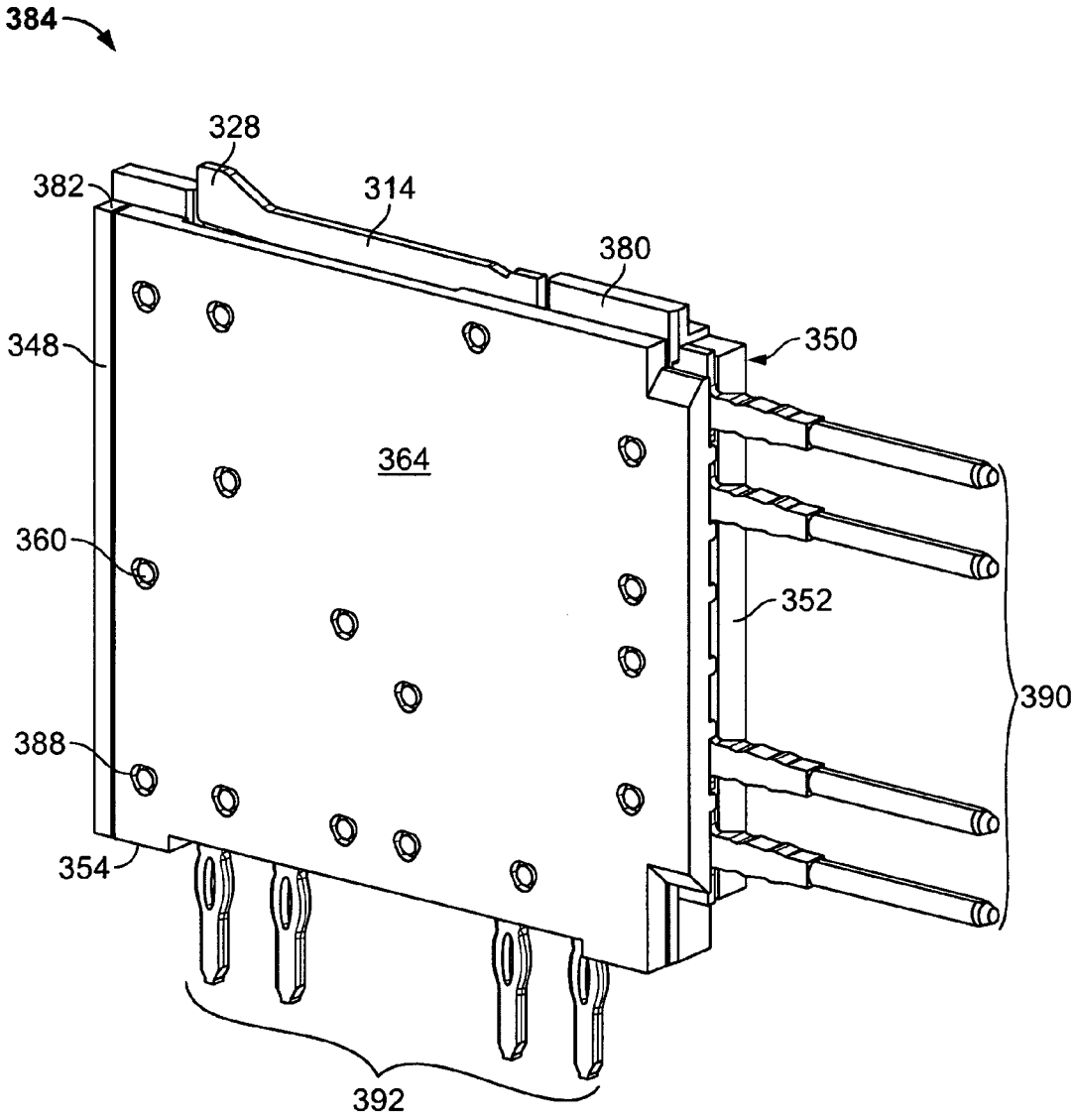
FIG. 6 illustrates a perspective view of a contact module with a cover joined to the back shell to hold the first pattern of contacts.

FIG. 6 illustrates a side perspective view of a signal contact module or wafer assembly 384 that includes the cover 364 securely held against the back shell 350. The cover 364 rests against the rear ledge 348. The cover 364 and back shell 350 are held together by a friction fit of the pins 360 within corresponding holes 388 to form a dielectric carrier. Once assembled, the contact module 384 has a connector pin pattern 390 extending from the mating edge 352, and a board pin pattern 392 extending from the board mounting edge 354. As shown in FIG. 5, ends 370 of certain channels 368 are open or empty.

Figure 7:
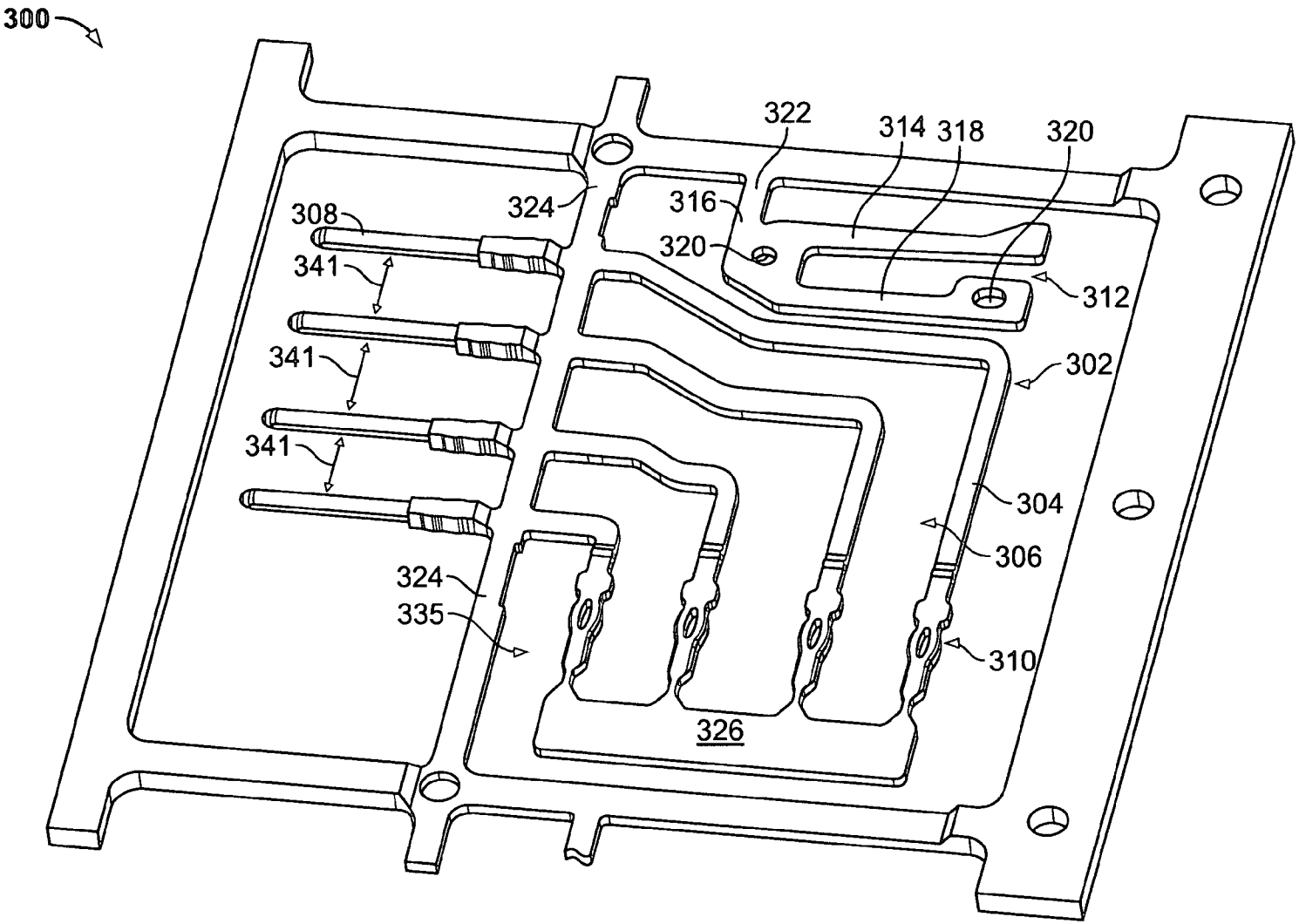
FIG. 7 illustrates a second pattern of contacts formed from the generic lead frame of FIG. 3 after removal of a second subset of contacts.

FIG. 7 illustrates another portion of the generic lead frame 302 on the carrier strip 300. In FIG. 7 the generic lead frame 302 has already had subset 332 (FIG. 3) of contacts 304 removed or dejunked. With reference to FIG. 3, in subset 332, alternating contacts 304 are removed to form a second contact pattern 335 that is shown in FIG. 7. The second contact pattern 335 includes four individual contacts 304 that are equally spaced from one another in a predetermined spaced-apart relationship. The spaced-apart relationship in the contact pattern 335 includes an even contact-to-contact spacing 341. By way of example, the second contact pattern 335 may be useful in connection with conveying individual signals that are not to be coupled in differential pair combinations. The contact-to-contact spacing 341 may be substantially maintained throughout the lead frame. The board mounting pins 310 are also evenly spaced from one another, although the distance between adjacent board mounting pins 310 may not necessarily be equal to the distance between adjacent connector mating pins 308.

Figure 8:
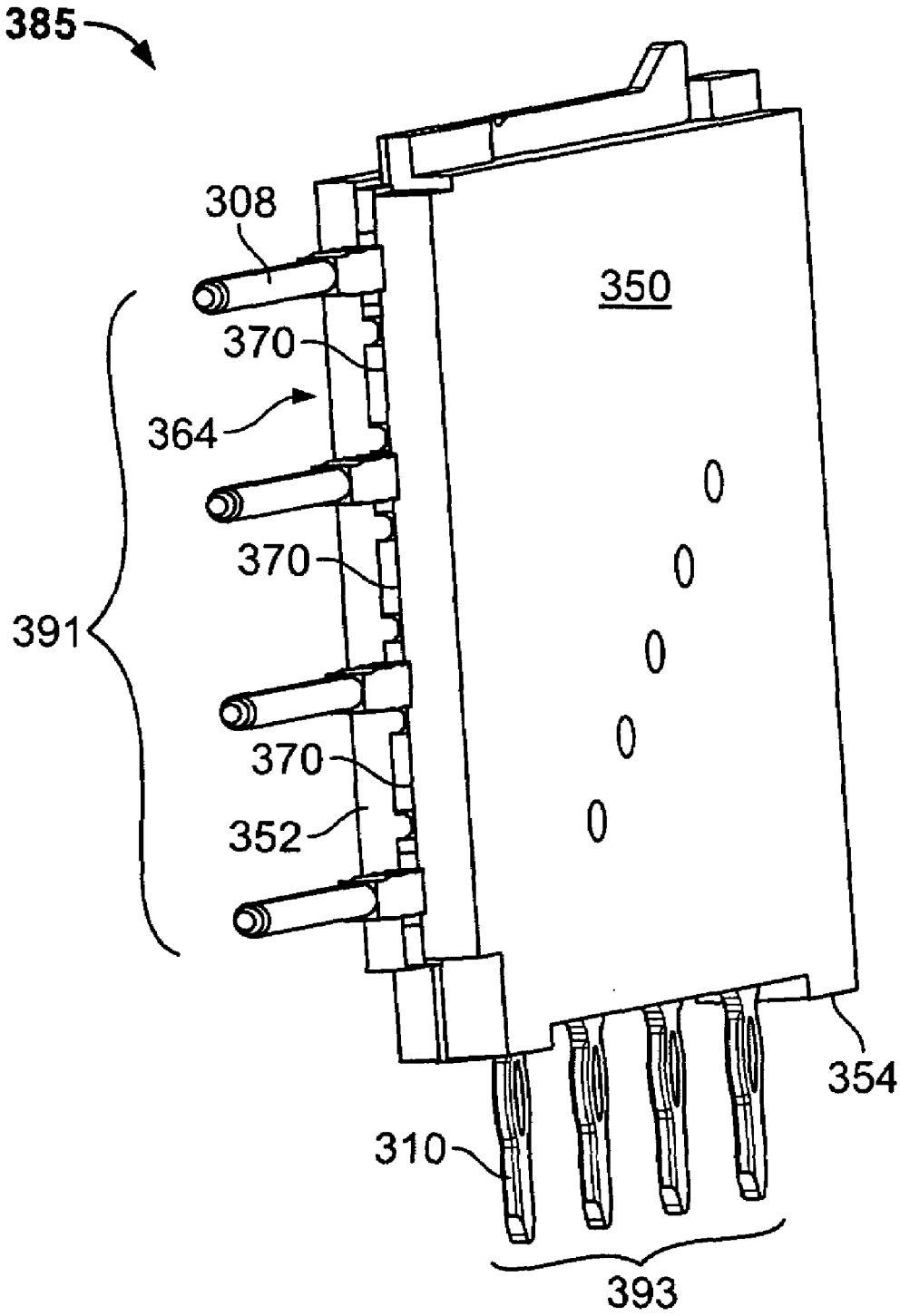
FIG. 8 illustrates a perspective view of a contact module holding the second contact pattern.

FIG. 8 illustrates a side perspective view of a signal contact module 385 that is formed when the second contact pattern 335 is loaded onto a back shell 350 and a corresponding cover 364 is secured to the back shell 350. The cover 364 and back shell 350 are held together by a friction fit between the pins 360 and holes 388 (not shown). Once assembled, the contact module 385 has a second connector pin pattern 391 extending from the mating edge 352, and a second board pin pattern 393 extending from the board mounting edge 354. The mating edge 352 includes alternating open channel ends 370 that are positioned between the board mounting pins 310.

Once assembled, each contact module 384 and 385 includes a series of empty channels 368 (FIG. 5) at each location where a contact 304 has been removed. The empty channels 368 are filled only with air.

Figure 9:
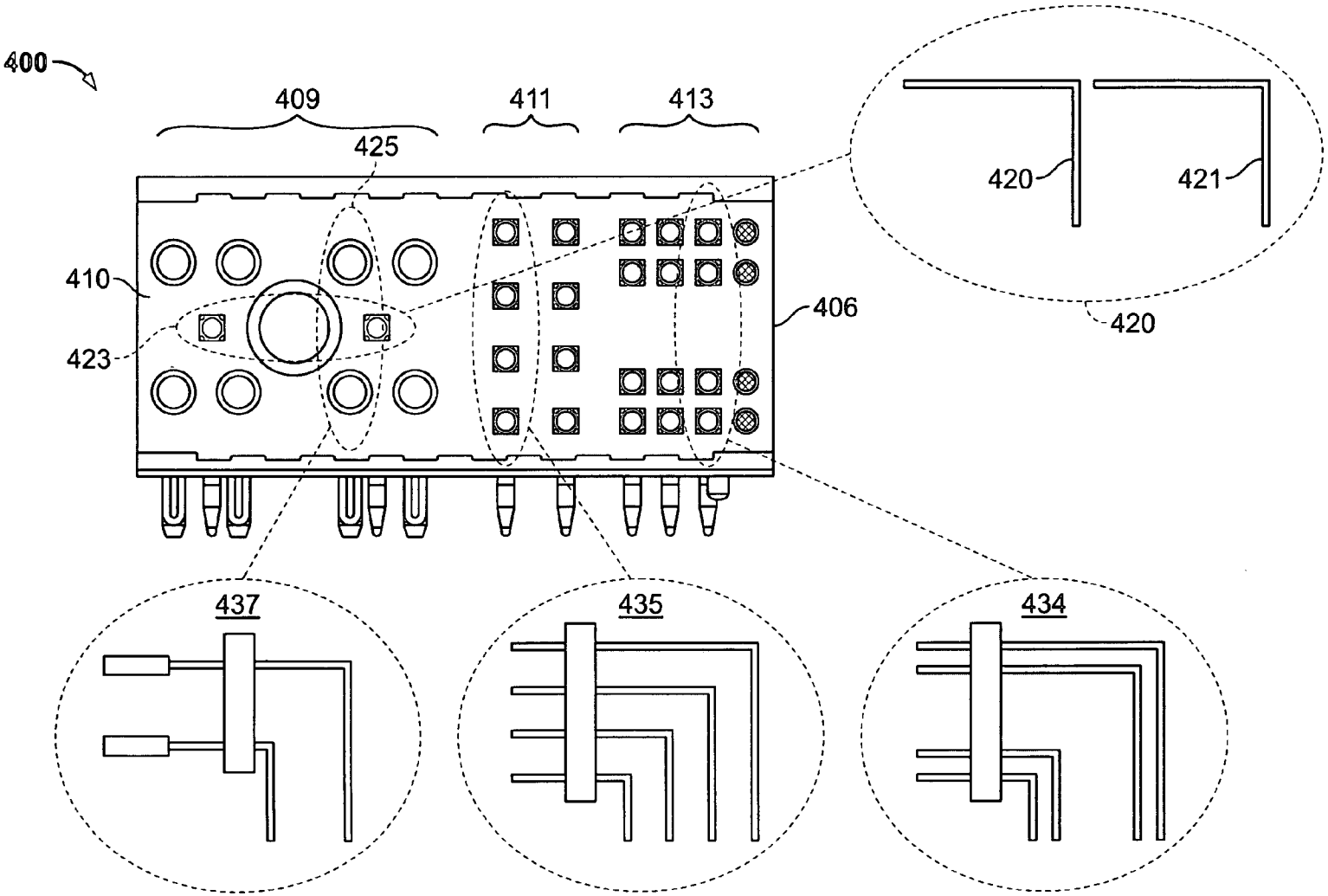
FIG. 9 illustrates a pin pattern for an electrical connector and graphical representations of contact patterns used to achieve the pin pattern.

FIG. 9 illustrates a front view of a mating end of an electrical connector 400 and graphical representations of exemplary contact patterns used therein. In FIG. 9, a mating end 410 of a connector 400 is shown. The mating end 410 includes a power delivery section 409, a signal section 411 and a signal section 413. The connector 400 has numerals assigned to each contact position #1 to #34. FIG. 9 also illustrates graphical representations of contact patterns 434 and 435 that are intended to be used in the signal sections 413 and 411, respectively.

As explained above, the contact patterns 434 and 435 are formed when certain contacts 304 (FIG. 3) are removed. In the example of FIG. 9, a pair of individual contacts 420 and 421 are shown. The individual contacts 420 and 421 constitute contacts that were removed from the first and second patterns 434 and 435. For example, the contacts 420 and 421 may constitute contact 304 (FIG. 3) in the center of two generic lead frames 302. Once the contacts 420 and 421 are removed from the generic lead frames 302 (FIG. 3), the individual contacts 420 and 421 may be loaded into the front wall 106 of the connector 400, such as at contact positions #27 and #32 (as shown in area 423). FIG. 9 also illustrates a power contact pattern 437 that is loaded into the power delivery section 409 in the column labeled 425.

In accordance with the foregoing, a method is provided for manufacturing an electrical connector. The method includes providing a series of common or generic lead frames 302 on a common carrier strip 300 to a contact removal/dejunking stage. Each generic lead frame 302 has an array of contacts 304 arranged in a common generic pattern. At the dejunking stage, a subset (e.g. 330, 332 or otherwise) of the contacts 304 is removed to form a first pattern 334 of contacts 304. The contacts 304 in the first contact pattern 334 have a first spaced-apart relationship (e.g. evenly spaced, arranged in differential pairs, and the like). Another generic lead frame 302 along the common carrier strip 300 is provided to the dejunking stage, at which a different subset 332 of contacts 304 is removed to form a second pattern 335 of contacts 304. The contacts 304 in the second pattern 335 have a second spaced-apart relationship that differs from the first spaced-apart relationship.

The first and second patterns 334 and 335 of contacts, while remaining on the carrier strip 300, are conveyed to a module loading stage. At the module loading stage, a first back shell 350 is presented to the first contact pattern 334, while a second back shell 350 is presented to the second contact pattern 335. The back shells 350 that are presented to each of the first and second contact patterns 334 and 335 have a similar generic pattern of ribs 366 and channels 368. Next, the first cover 364 is joined to the first back shell 350, while a second cover 364 is joined to the second back shell 350. The covers 364 that are presented to each of the first and second back shells 350 have a common shape. In accordance with the foregoing process, only one configuration of back shells 350 and covers 364 is needed for all signal contact patterns.

While the invention has been described in terms of various specific embodiments, those skilled in the art will recognize that the invention can be practiced with modification within the spirit and scope of the claims.

What is claimed is:

1. An electrical connector comprising:

a housing; and multiple contact modules loaded into the housing, each of the contact modules including an array of contacts held in a dielectric carrier, each of the arrays including multiple contacts formed as part of a generic lead frame, the contacts in each of the arrays being spaced-apart from each other in a respective contact pattern, at least two of the contact modules holding different first and second patterns of the contacts, wherein the contacts in the first pattern have a first spaced-apart relationship, and the contacts in the second pattern have a different second spaced-apart relationship, and wherein the generic lead frame includes both the first pattern and the second pattern such that either one of the first and second patterns is selectively obtained from the generic lead frame.

2. The connector of claim 1, wherein the first pattern is formed by removing, from the generic lead frame, a first subset of the contacts to provide the first spaced-apart relationship between a remaining subset of the contacts.

3. The connector of claim 1, wherein the first and second patterns are formed by removing, from the generic lead frame, different first and second subsets of the contacts to provide the first and second spaced-apart relationships, respectively.

4. The connector of claim 1, wherein each of the carriers is formed with a back shell and a cover that enclose a corresponding one of the first and second patterns of contacts, at least one of the back shell and cover having channels formed therein to receive the contacts, the channels being arranged in a generic pattern that encompasses both of the first and second patterns such that the back shells and covers are configured to receive either of the first and second patterns of contacts.

5. The connector of claim 1, further comprising a series of the generic lead frames joined to a carrier strip, each of the generic lead frames having a common number of contacts that are arranged in a common pattern.

6. The connector of claim 1, wherein each of the contacts terminates at opposite ends as pins, first and second generic lead frames being initially formed with a common number of pins on opposite ends thereof, the first and second contact modules having different first and second pin patterns after first and second subsets of contacts are removed from the first and second generic lead frames, respectively.

7. The connector of claim 1, wherein the housing includes a front wall that separates a loading end from a mating end, the contact modules being loaded through the loading end, the front wall having a pin pattern therethrough that receives ends of the contacts in the contact modules.

8. The connector of claim 1, wherein the contact modules carry at least one of signal contacts and power contacts.

9. The connector of claim 1, further comprising an individual contact loaded into the housing separate from the contact modules, the individual contact being removed from the generic lead frame when forming the first pattern of contacts provided in a corresponding one of the contact modules.

10. The connector of claim 1, further comprising individual first and second contacts loaded into the housing separately from the contact modules, the individual first and second contacts being removed from first and second generic lead frames when forming the first and second patterns of contacts provided in corresponding first and second contact modules.

11. An electrical connector comprising:

a housing; and multiple contact modules loaded into the housing, each of the contact modules including an array of contacts held in a dielectric carrier, each of the arrays including multiple contacts formed as part of a generic lead frame, the contacts in each of the arrays being spaced-apart from each other in a respective contact pattern, at least two of the contact modules holding different first and second patterns of the contacts, wherein the contacts in the first pattern have a first spaced-apart relationship, and the contacts in the second pattern have a different second spaced-apart relationship, wherein each of the carriers is formed with a back shell and a cover that enclose a corresponding one of the first and second pattern of contacts, at least one of the back shell and cover having channels formed therein to receive the contacts, the channels being arranged in a generic pattern that encompasses both of the first and second patterns such that the back shells and covers are configured to receive either of the first and second patterns of contacts.

12. The connector of claim 11, wherein the first pattern is formed by removing, from the generic lead frame, a first subset of the contacts to provide the first spaced-apart relationship between a remaining subset of the contacts.

13. The connector of claim 11, further comprising a series of the generic lead frames joined to a carrier strip, each of the generic lead frames having a common number of contacts that are arranged in a common pattern.

* * * * *